US005894637A

United States Patent [19]

Graf

[11] Patent Number: 5,894,637

[45] Date of Patent: Apr. 20, 1999

[54] TOP COMB FOR A COMBER

[75] Inventor: Ralph Armin Graf, Freienbach, Switzerland

[73] Assignee: Graf + Cie AG, Rapperswil, Switzerland

[21] Appl. No.: 08/705,692

[22] Filed: Aug. 27, 1996

[30] Foreign Application Priority Data

Aug. 28, 1995 [DE] Germany ..... 195 31 605

[51] Int. Cl.[6] ..... D01G 19/10

[52] U.S. Cl. ..... 19/115 R

[58] Field of Search ..... 19/115 R, 29, 19/215, 216, 217, 218, 219, 220, 221, 223, 224, 233, 234, 235, 125, 113, 129 R, 114, 129 A; 132/158, 159

[56] References Cited

U.S. PATENT DOCUMENTS

| | | | |
|---|---|---|---|
| 2,404,755 | 7/1946 | Smith | 19/129 R |
| 2,927,347 | 3/1960 | Kohler | 19/129 R |
| 2,985,923 | 5/1961 | Kohler | 19/129 R |
| 3,601,861 | 8/1971 | Moriwaki | 19/129 R |
| 4,928,356 | 5/1990 | Egerer | 19/129 R |
| 5,019,110 | 5/1991 | Stauffer et al. | 19/128 |
| 5,581,848 | 12/1996 | Egerer | 19/114 |

FOREIGN PATENT DOCUMENTS

| | | |
|---|---|---|
| 0 557 698 | 9/1993 | European Pat. Off. . |
| 30 07 245 | 9/1981 | Germany . |
| 4205006 | 8/1993 | Germany . |

*Primary Examiner*—Michael A. Neas
*Assistant Examiner*—Larry D. Worrell, Jr.
*Attorney, Agent, or Firm*—Herbert Dubno; Andrew Wilford

[57] ABSTRACT

A top comb for a comber has a longitudinally elongated support element extending transverse to a combing direction and a plurality of comb teeth fixed next to one another in a longitudinally extending row along the support element. Each tooth is formed at least partially as a sawtooth-wire segment having at least one sawtooth in turn formed with a pair of longitudinally oppositely directed side flanks extending parallel to the combing direction and a front longitudinally extending tooth face bridging the respective side flanks.

15 Claims, 2 Drawing Sheets

TOP COMB FOR A COMBER

FIELD OF THE INVENTION

The present invention relates to a comber. More particularly this invention concerns a top comb for a comber.

BACKGROUND OF THE INVENTION

A standard comb for a comber for combing a fiber fleece in a combing direction has a support element and a plurality of comb teeth which engage into the fiber fleece and which are fixed next to one another in a row extending in a direction perpendicular to the combing direction.

The comber serves for finishing yarns formed of textile fibers. It is normally installed in the yarn production line between the card and the drawing frame. The main purpose of the comber is to strip out short fibers from the card sliver produced by the card, that is to improve the staple of the raw-fiber material while improving the parallel orientation of the individual fibers in the fiber fleece delivered from the card as a card sliver. A side effect attained by the comb is the cleaning of the fiber fleece of nets and husks.

In order to obtain the above-described improvements in the fiber fleece a circular comb rotating about a stationary axis passes through a fiber tuft of the fiber fleece fed from a feed cylinder and held by a gripper, then the combed fiber tuft is merged with an already combed fleece, and is pulled by engagement of a top comb in the fiber tuft with simultaneous pulling of the combed fleece from the feed cylinder and from the uncombed fleece. In this process the desired improvement of the parallelism of the individual fibers of the fiber fleece as well as the staple improvements by stripping out short fibers are effected by the interaction of the circular comb and the top comb.

The top comb of standard combers is normally formed as a support element in the form of a sheet-metal strip and comb teeth welded thereon in the form of flat needles. In particular at high operating speeds of the comber it has proven disadvantageous that using such top combs meets none of the requirements of high-value yarns of sufficient parallelism of the individual fibers of the fiber fleece, while simultaneously a substantial fouling of the top comb which makes frequent cleaning necessary is observed.

OBJECTS OF THE INVENTION

It is therefore an object of the present invention to provide an improved top comb for a comber.

Another object is the provision of such an improved top comb for a comber which overcomes the above-given disadvantages, that is which gives a high machine-running time and operating speed with a qualitatively better combing process and combed product strip.

SUMMARY OF THE INVENTION

A top comb for a comber has according to the invention a longitudinally elongated support element extending transverse to a combing direction and a plurality of comb teeth fixed next to one another in a longitudinally extending row along the support element. At least some of the teeth are formed as a sawtooth-wire segment having at least one sawtooth in turn formed with a pair of longitudinally oppositely directed side flanks extending parallel to the combing direction and a front longitudinally extending tooth face bridging the respective side flanks.

With this formation of the comb teeth of the top comb, fiber guiding is substantially improved in a manner which produces at higher operating speed of the comber extremely fine yarns with satisfactory parallelism of the individual fibers of the combed fleece. In addition the improved fiber guiding reduces plugging of the passages between adjacent sawtooth-wire sections secured on the support element and thereby reduces fouling of the top comb. As a result there is an increase in the service interval during which the comber can be operated without being cleaned and therefore an increase in the machine running time of the comber. This effect is enhanced by the fact that the use of sawtooth-wire segments as comb teeth permits an accurate arraying of the tips of the top comb so as to suppress engagement of individual pairs of fiber fleeces right to the support element where the individual fibers could get caught or hooked.

According to the invention each tooth is unitarily formed with a foot fixed to the blade and having a predetermined longitudinal dimension and a blade forming the sawtooth and having a longitudinal dimension substantially smaller than the foot dimension. The feet of the teeth longitudinally abut one another. In this manner there is no direct connection between the actual combing region, that is the passages between the individual sawteeth and the region where the sawtooth-wire segments are fixed on the support element so that the top comb of this invention stays clean. The combing region is delimited instead by the surfaces turned toward the blades of the adjacent and abutting feet. This improvement with respect to keeping the comb clean is based on the recognition that with top combs of the described type with comb elements in the form of flat needles fouling is mainly due to the catching of individual fibers on solder deposits in the region where the flat needles are secured to the support element. With the above-described separation of the mounting region from the comb teeth of the actual combing region by the particular formation of the sawtooth-wire segments with a foot and a blade of different width this type of fouling is effectively prevented. In addition the foot can also be formed as a profiled foot so as further to increase the accuracy of tip position of the top comb. Thus engagement of the individual fibers to the foot of the tooth is further suppressed to further improve the ability of keeping the top comb clean.

The feet in accordance with this invention are each formed with a recess in which the support element is fitted. This improves the stability of the mounting of the sawtooth-wire segments on the support element.

The top comb according to the invention further has a weld joint securing each foot to the support element. Thus brazing or soldering the comb in place makes a solid connection and further eliminates a place where fibers could lodge.

In another system in accordance with this invention the support element is formed with a recess in which the feet are fitted. More particularly the feet are clamped in the recess. This is done when the support element has a pair of parts together defining the recess and the clamping means, which can be a simple screw or bolt, presses the parts together to clamp the feet in the recess. In this manner the production of a top comb according to the invention is simplified when neither a solder or weld procedure is used to mount the comb teeth. Furthermore cleaning of the top comb can further be improved because the catching of individual fibers at solder deposits in the mounting region of the comb teeth is completely eliminated. In addition screw mounting to secure the sawtooth-wire segments on the support element allows one to replace worn-down comb teeth without simultaneously having to replace the support element.

A particularly good guiding of the individual fibers of the fiber fleece is achieved when according to the invention each tooth is formed with two such sawteeth spaced apart in the combing direction.

Damage to the individual fibers leading to poorer flow of the staple through use of the top comb according to the invention is reduced when each sawtooth is formed between its front face and side flanks with rounded corners.

In order to avoid damaging the individual fibers of the fiber fleece the side flanks of each sawtooth run toward each other away from the support element and toward a tooth tip.

Engagement of the individual fibers of the fiber fleece all the way to the tooth foot is in particular effectively avoided when each front face is arcuately concave in the combing direction. In this manner on the one hand local wearing of the sawteeth in the region of the tooth feet is prevented and on the other hand the arcuate toothed shape of the sawteeth effectively avoids lodging of individual fibers of the fiber fleece at the tooth feet of the top comb. This further increases the machine running time because the service time needed to clean and swap out the top comb is reduced.

According to another feature of this invention each tooth has a back face and the support element has a back face substantially flush with the teeth back faces. The side flanks of each tooth diverge in a direction away from the support element from the side flanks of adjacent teeth.

BRIEF DESCRIPTION OF THE DRAWING

The above and other objects, features, and advantages will become more readily apparent from the following description, reference being made to the accompanying drawing in which.

SPECIFIC DESCRIPTION

Figure 1C:
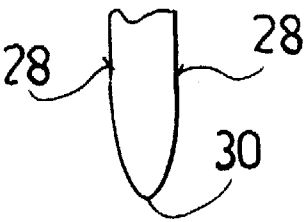
FIG. 1*c* is an enlarged detail of the region shown at Ic in FIG. 1*a* of a tooth tip of a top comb according to the invention.

As seen in FIGS. 1*a* through 1*d* a top comb according to the invention consists of a support element 10 in the form of a strip of sheet metal and a plurality of comb teeth 20 fixed thereon. The comb teeth 20 are here fixed next to one another in a row extending perpendicular to the arrow 27 of FIG. 1*b* and parallel to the direction of arrow 26 of FIG. 1*a*. Each of the comb teeth 20 is shaped as a sawtooth-wire segment with a foot 22 and a blade 24, the foot 22 being welded to the support 10. The width of the foot 22 in the direction or arrow 26 is greater than the width of the blade 24 measured in the same direction 26. In this manner, in spite of the juxtaposition of the sawtooth-wire strips against each other at their feet 22, passages 31 are formed between the blade side flanks 28 of the individual sawtooth-wire sections for combing action.

Figure 1D:
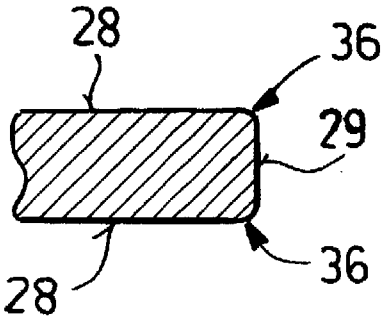
FIG. 1*d* is detail of an enlarged section taken along line Id—Id of FIG. 1*b;*
Figure 1B:
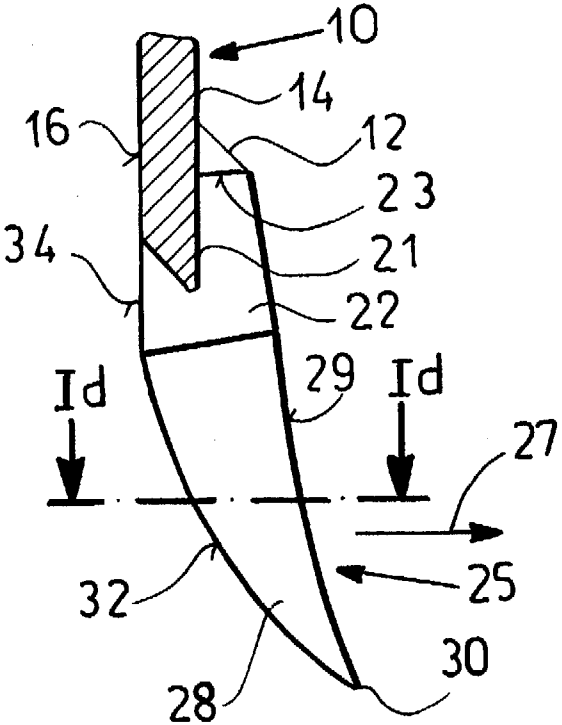
FIG. 1*b* is a side cross-sectional view of the top comb shown in FIG. 1*a;*
Figure 1A:
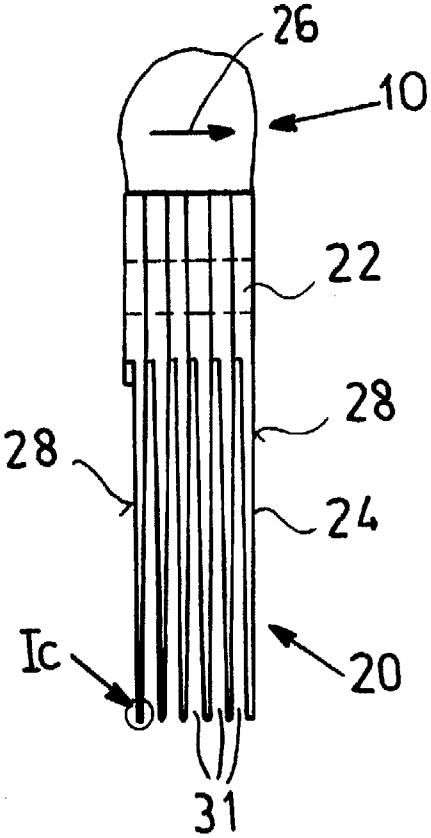
FIG. 1*a* is a front view of a first embodiment of a top comb according to the invention.

As can be seen from FIG. 1*b*, the blade flanks 28 extend generally parallel to the combing direction shown by the arrow 27 while front faces 29 of the sawteeth extend generally perpendicular thereto (see FIG. 1*d*). The front faces 29 of the sawteeth are arcuate and concave in the combing direction. In order to hold down the sawtooth-wire strip a V-shaped recess 21 receiving the support 10 is formed in each foot 22. The depth of the recess 21 increases starting from a back side 34 of the tooth foot 32. The support 10 is shaped complementarily to the recess 21 so that a back side 16 of the support 10 is flush with a back side 34 of the tooth foot 22. In this manner fibers from the fiber fleece cannot get caught in the back side of the top comb. The sawtooth-wire strip is mounted in place by a solder joint 12 between an end surface 23 of the foot 22 opposite the tooth 25 and a front side 14 of the support element 10. This particular shape of the recess 21 in conjunction with the corresponding shape of the support element 10 reinforces the solder joint 12 against stresses of the sawtooth-wire strip in the combing direction shown by arrow 27.

As can be seen clearly from FIG. 1*c* the flanks 28 of the sawteeth run in the region of the tooth tips 30 toward each other in order to facilitate gentle engagement of the top comb into the fiber fleece to be combed. In order to further protect the fiber fleece, as shown in FIG. 1*d* the transition or edge 36 between the tooth front face 29 and the tooth flanks 28 is rounded. This prevents damage to the individual fibers which could lead to an impairment of the fiber flow at a sharp transition.

Figure 2:
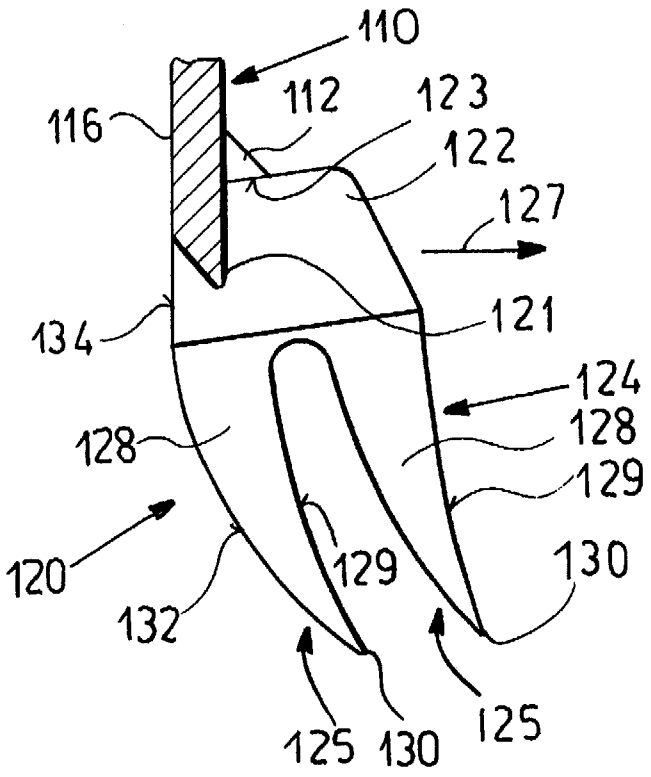
FIG. 2 is a side cross-sectional view of a second embodiment of a top comb according to the invention.

The embodiment of an inventive top comb according to FIG. 2 corresponds generally to the embodiment of FIGS. 1*a*–1*d* with reference numerals from FIGS. 1*a*–1*d* augmented by 100. A difference is that the blade 124 of the sawtooth-wire segment forming the comb teeth has two sawteeth 125 arranged one behind the other in the combing direction 127. Each of the sawteeth 125 is arcuate with a forwardly concave front face 129. In addition the tooth flanks 128 merge at the tooth tips 130. The shape of the recess 121 serving to hold the support 110 as well as the use of a solder joint 123 on the end surface 123 of the foot 122 opposite the blade 124 correspond generally to the embodiment described with reference to FIGS. 1*a*–1*d*. In addition the support element 110 of the top comb shown in FIG. 2 is shaped such that its back side 116 is flush with the back side 134 of the tooth foot 122 behind the two teeth 125.

Figure 3:
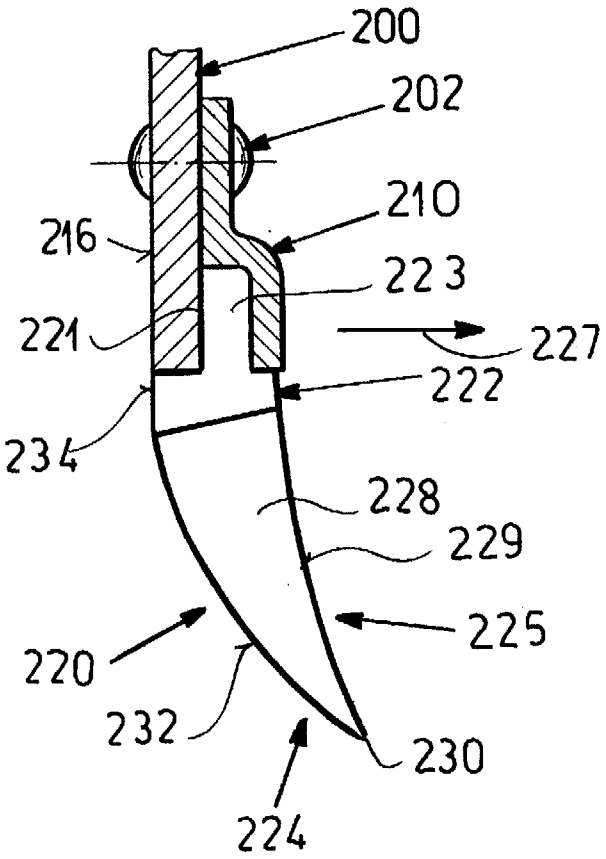
FIG. 3 is a side cross-sectional view of a third embodiment of a top comb according to the invention.

In the embodiment of the invention shown in FIG. 3, where reference numerals from FIG. 1 are used augmented by 200, the support element is formed of two parts 200 and 210 extending parallel to each other in a direction perpendicular to the combing direction 227. The two foot parts 200 and 210 together form a recess 221 serving to receive a portion 223 of a foot 222 of a sawtooth-wire segment. The portion 223 of the foot 222 is clamped in this recess 221 by a force exerted by screws 202 extending through the two support elements 200 and 210 so as securely to hold the sawtooth-wire segment in the support element. The front faces 229 of the sawteeth 225 of the top comb shown in FIG. 3 are also arcuate and concave in the combing direction arrow 227. In addition the back side 216 of the first support element part 200 is flush with the back faces 232 of the sawteeth 225 joining the back side 234 of the tooth foot 222. The tooth flanks 228 of the sawteeth 225 run toward each other in the region of the tooth tips 230 to ensure gentle penetration of the top comb into a fiber fleece. Finally transitions or edges between the teeth front faces and the tooth side faces 228 are rounded to avoid fiber damage.

The invention is not limited to the embodiments described with reference to the drawings. For example it is possible to use sawtooth-wire segments with more than two sawteeth to form the comb teeth. In addition it is possible to use sawtooth-wire segments with straight tooth front faces.

Furthermore the sawtooth-wire segments can be fixed by glue on the support element or, when two-part supports are used, by rivets.

I claim:

1. A top comb for a comber, the top comb comprising:

a longitudinally elongated support element extending transverse to a combing direction; and a plurality of comb teeth fixed next to one another in a longitudinally extending row along the support element and at least some of the teeth formed as a sawtooth-wire segment having at least one sawtooth in turn formed with a pair of longitudinally oppositely directed side flanks extending parallel to the combing direction and a front longitudinally extending tooth face bridging the respective side flanks, each sawtooth being formed between its front face and side flanks with rounded corners, the front face of the one sawtooth being arcuately concave in the combing direction.

2. The top comb defined in claim 1 wherein each tooth is unitarily formed with a foot fixed to the support element and having a predetermined longitudinal dimension and a blade forming the sawtooth and having a longitudinal dimension substantially smaller than the longitudinal dimension of the respective foot, the feet of the teeth longitudinally abutting one another.

3. The top comb defined in claim 2 wherein the feet are each formed with a recess in which the support element is fitted.

4. The top comb defined in claim 2 further comprising a weld joint securing each foot to the support element.

5. The top comb defined in claim 2 wherein the support element is formed with a recess in which the feet are fitted.

6. The top comb defined in claim 2 further comprising means for clamping the feet in the recess.

7. The top comb defined in claim 6 wherein the support element has a pair of parts together defining the recess and the clamping means presses the parts together to clamp the feet in the recess.

8. The top comb defined in claim 7 wherein the clamping means is at least one screw engaged between the parts.

9. The top comb defined in claim 2 wherein each tooth is formed with two such sawteeth spaced apart in the combing direction.

10. The top comb defined in claim 2 wherein the side flanks of each sawtooth run toward each other away from the support element and toward a tooth tip.

11. The top comb defined in claim 2 wherein each tooth has a back face and the support element has a back face substantially flush with the teeth back faces.

12. The top comb defined in claim 2 wherein the side flanks of each tooth diverge in a direction away from the support element from the side flanks of adjacent teeth.

13. A top comb for a comber, the top comb comprising:

a longitudinally elongated support element extending transverse to a combing direction and formed with a front side;

a plurality of comb teeth fixed next to one another in a longitudinally extending row along the support element and at least some of the teeth formed as a sawtooth-wire segment having at least one sawtooth unitarily formed with:

a blade having a pair of longitudinally oppositely directed side flanks extending parallel to the combing direction and a front and back longitudinally extending tooth faces bridging the respective side flanks, and a foot on said blade and extending between the front and back toothfaces; and a weld joint connecting the foot of the one sawtooth to said support element and extending from the front side thereof toward the front tooth face of the sawtooth to reinforce the latter against stresses of said sawtooth-wire segment in the combing direction.

14. The top comb defined in claim 13 wherein each front face is arcuately concave in the combing direction.

15. The top comb defined in claim 13 wherein said foot is provided with a recess extending toward the blade and receiving said support, the recess being formed with a slanted bottom extending downwardly from a back of the foot toward the sawtooth front face, said support being formed with a bottom surface shaped complementary to said slanted bottom of the recess, and a back side flush with the back of the foot upon mounting said sawtooth-wire segment on said support.

* * * * *